US005379673A

United States Patent [19]

Vogt

[11] Patent Number: 5,379,673

[45] Date of Patent: Jan. 10, 1995

[54] METHOD FOR TREATMENT OF REEDS

[75] Inventor: Robert F. Vogt, Atlanta, Ga.

[73] Assignee: Carvo Musical Products, Inc., Atlanta, Ga.

[21] Appl. No.: 179,572

[22] Filed: Jan. 7, 1994

[51] Int. Cl.[6] ..... G10D 9/02; G07D 1/00

[52] U.S. Cl. ..... 84/383 A; 453/53

[58] Field of Search ..... 84/383 A, 380 A; 424/49, 53

[56] References Cited

U.S. PATENT DOCUMENTS

| | | | |
|---|---|---|---|
| 1,776,566 | 9/1930 | Newton et al. | 84/383 R |
| 4,856,405 | 8/1989 | Humphrey | 84/383 R |
| 5,039,515 | 8/1991 | Korf | 424/53 |

OTHER PUBLICATIONS

Good Vibrations Musician-scientists probe the wood-wind reed, Karen F. Schmidt, Science News 140-39-2-394 (1991).

*Primary Examiner*—Michael L. Gellner
*Assistant Examiner*—Cassandra C. Spyrou
*Attorney, Agent, or Firm*—Olive & Olive

[57] ABSTRACT

A composition and method for treating reeds to prolong their useful life containing an oxidizing agent, such as hydrogen peroxide, a humectant, such as glycerol and water. Reeds are preferably routinely treated with the composition after each use or on a weekly basis by submerging the reeds in the composition at least up to the end of their playing surfaces until the bubbling action ceases. They are then removed from the solution, wiped off and stored.

3 Claims, No Drawings

METHOD FOR TREATMENT OF REEDS

BACKGROUND OF THE INVENTION

1. Field of the Invention

This invention relates to reeds, which are made of cane or other plant material and are used for woodwind instruments, and in particular relates to a composition and method for treating reeds to improve quality and durability of the reeds.

2. Description of the Related Art

Most natural reeds for woodwind instruments are made from cane, a large fibrous plant related to grasses. Professional musicians have long realized that cane reeds have a limited useful lifetime because they dry out, causing warpage, which degrades their musical qualities. In addition, organic debris from mouth tissue and saliva are constantly forced into the pulpy reed material when the instrument is played, obstructing the ability of the reed to vibrate freely and therefore to produce musical tones. Microorganisms such as molds and bacteria also of ten colonize cane reeds, rendering them unsanitary, accelerating their degradation by producing extreme acid or alkaline conditions, and further obstructing their free vibration.

Prior methods devised to prolong the useful life of reeds include impregnating the reeds with water-resistant materials, including plastics and oils. See for example U.S. Pat. Nos. 1,776,566 of Newton; 3,340,759 of Petzke; and 4,856,405 of Humphrey and British Patent No. 1,160,838. The majority of woodwind musicians find that reeds treated with such materials can no longer be hydrated and have unacceptable tonal qualities.

Other attempts to overcome the problem include making synthetic reeds (e.g., U.S. Pat. No. 2,230,933 of Caire). Generally such reeds also have unacceptable tonal qualities.

Treatments with hydrogen peroxide have been used by professional musician to clean reeds, but such treatments do not protect the reeds from drying, and in fact generally accelerate reed degradation.

It is therefore an object of this invention to provide a composition and method for treating reeds which allow reeds to remain moist and/or to be hydrated without altering their hydrophilic qualities, while retaining acceptable tonal qualities.

It is a further object of this invention to provide a composition and method for treating reeds which removes organic debris from the reeds including associated microorganisms, and inhibits growth of microorganisms.

Other objects and advantages will be more fully apparent from the following disclosure and appended claims.

SUMMARY OF THE INVENTION

The invention provides a composition and method for treating reeds to prolong their useful life. The composition comprises an oxidizing agent and a humectant. Preferably the composition is at a neutral pH.

Reeds are preferably routinely treated with the composition after each use or on a weekly basis, Such treatment comprises submerging the reeds in the composition at least up to the end of their playing surfaces until the bubbling action ceases. They are then removed from the solution, wiped off and stored.

Other aspects and features of the invention will be more fully apparent from the following disclosure and appended claims,

DETAILED DESCRIPTION OF THE INVENTION AND PREFERRED EMBODIMENTS THEREOF

The composition of the present invention in the preferred embodiment comprises a oxidizing agent and a humectant in an aqueous composition.

Preferred oxidizing agents include hydrogen peroxide and other oxidizing agents which are not toxic and are suitable for use in the mouth, for example, carbamide peroxide which is used in various gum cleansers and earwax removers. Particularly for solid formulations of the invention for dissolution in water as discussed below, oxidizing agents may be used, such as sodium perborate, which is now used in powdered and tablet denture cleansers and are suitable for incorporation in a tablet.

Preferred humectants include glycerol (glycerin), pectin, and carboxymethylcellulose. It is important when using humectants as glycerol, which may have explosive characteristics upon contact with strong oxidizing agents, that strong oxidizing agents which are known to cause such reactions not be used, and that there not be direct contact between the concentrated humectant and the oxidizing agent during preparation or use of the composition of the invention if there is any possibility of such a strong reaction.

It is important that the composition of the invention be aqueous so that water may easily enter the reed interstices after treatment of the reed with the composition, and so that the entry into the reed interstices is not blocked by the composition of the invention.

A most preferred composition contains about 3% hydrogen peroxide and about 7–8% glycerol in water (all percentages herein unless otherwise stated are volume/volume). This concentration of hydrogen peroxide provides adequate cleansing without destroying the reed fibers so long as the humectant is present. Glycerol at this concentration does not leave any notable residue nor cause a "dead" reed response from waterlogging. The invention contemplates that differently balanced formulations may be desirable under different conditions. For example, higher concentrations of humectants may be better for drier climates.

Preferably, the composition of the invention is at a neutral pH so that reeds that have been exposed to alkaline conditions in the mouth or to acidic conditions from microbial growth are placed at a neutral pH (about pH 7.0) when they are treated according to the invention.

During manufacture or before use, the pH of the composition is preferably at about pH 7.0, and may be buffered to remain at about a neutral pH. Thus, the invention also contemplates that a buffering agent as is known in the art, and is not toxic, for example, phosphate salts or triethanolamine, may be added to the other components of the composition of the invention to maintain the pH at about neutral.

The composition of the invention may be formulated and sold in liquid form in appropriate concentrations so that it is ready to use, or it may be formulated and sold in a concentrated form which requires dilution with water before use. Alternatively, the composition may be formulated as a solid, for example, a tablet, using methods known in the art for providing oxidizing agents or other components in a solid form for suspension or solution in water. For example, hydratable tablets or other solid or compacted forms may be prepared using methods known in the art such as those used for preparation of "ALKA-SELZER" and for "EFFERDENT". The tablets may include glycerol, or may be prepared for use for treatment of reeds by adding one or more tablets to water along with the appropriate aliquot of glycerol.

After purchase and hydration or dilution as necessary, the composition is used by placing an aliquot of the composition in a container which is of sufficient size and dimensions to allow placement of the desired number of reeds therein. The reed(s) are submerged in the composition at least up to the end of their playing surface ("vamps"). This results in the formation of bubbles, particularly if the reed(s) contain substantial amounts of easily oxidized material. The reeds are allowed to soak until the bubbling action ceases indicating that cleansing is complete, which is usually 10–15 minutes. The reeds are then removed from the composition, wiped gently with tissue or similar material to remove excess volume of the composition, and stored in a reed holder until the next use. The reeds are allowed to dry during storage through natural evaporation, the rate of which will vary depending on the ambient conditions. Preferably, the reeds are treated on a regular basis even if they are not being used, for example, weekly, or after each use, if oftener. The composition of the invention is preferably discarded after use.

The features and advantages of the present invention will be more clearly understood by reference to the following examples, which are not to be construed as limiting the invention.

EXAMPLES

Example I. Preparation and Testing of Compositions

Compositions containing varying amounts of glycerol (ranging from 3% to 20%), with or without varying amounts of hydrogen peroxide (ranging from 1% to 3%) were tested on reeds. The results were compared with results on reeds which had received no treatment. The initial pH of the compositions tested was neutral (about pH 7.0).

Example II. Reeds Tested

Reeds prepared for use in clarinets, oboes and saxophones were tested with various compositions as discussed in Example I. Reeds were first selected for their musical qualities as is routinely done by reed players. The brands tested included RICO ROYAL TM, VANDORENREGULAR TM, and JAVA TM (Rico/-Lavoz Company, Sun Valley, Calif.) as well as custom-made oboe reeds. Reed strengths ranging from 2 to 4 using standard reed rating criteria (mediumsoft to hard) were included in the tests. Approximately 100 reeds were tested with various formulations during the initial exploratory research on this invention, and approximately 40 reeds have been tested with the preferred formulation as discussed herein.

Example III. Testing of Reeds

Among the reeds tested, some were treated with the test compositions as often as the musician deemed necessary, and other "control" reeds were left untreated. Other treatment schedules included: (a) treating the reeds after each use; (b) treating the reed weekly; and (c) treating the reeds only when they were not satisfactory for use.

After preparation of the compositions, the testing consisted of submerging the reeds at least up to the end of their playing surface in about 30 ml of the particular composition until the bubbling action ceased, usually between 5 and 15 minutes, but as long as 60 minutes for reeds that had not been treated regularly. Longer treatment times did not appear to improve the reed quality, and in some cases appeared to cause the reed to become waterlogged. The reeds were then wiped gently and stored under ambient conditions in a REEDGUARD TM reed holder (La Voz, Sun Valley, Calif.). Although other reed holders may be used, the REEDGUARD TM reed holders have a hinged vamp cover that applies gentle pressure against the reed vamp, so that the reed holder not only protects the reed, but also keeps the reed flat against the bottom surface of the reed holder.

Example IV. Test Criteria

The original qualities of each reed when it was new were used to establish the reference point for evaluation of the tested reeds. Reeds were evaluated on the basis of their ability to produce resonant, musical tones without "squeaking", a common problem when reeds become too dry. They were further evaluated for the appearance of moldy growth and/or warping. Each time the reed was played in performance or practice sessions for at least one hour was considered one "use" of that reed.

Example V. Results of Testing

Results show that the best formulation for maintaining reed quality contains 5–10% glycerol and about 3% hydrogen peroxide. Preferably the concentration of glycerol is about 7–8%, and most preferably the concentration of glycerol is 7%.

The use of 3% hydrogen peroxide, by itself, provides the most effective cleansing of the reeds but when used alone causes the reeds to dry out and warp upon repeated use. The addition of at least 5% glycerol to a composition containing hydrogen peroxide as in the invention prevents the adverse action of hydrogen peroxide. Glycerol concentrations, however, above 10% cause reeds to "deaden" from over-hydration after repeated treatment. Glycerol concentrations in the range of 7–8% provide the most effective treatment without the disadvantages of overhydration.

Reeds which have been treated with the composition containing the preferred concentrations of glycerol and hydrogen peroxide on a weekly basis retain a clean appearance and do not show growth of molds or bacteria, even up to at least two years after last use. With proper storage, such as in a reed holder, reeds treated with the composition of the invention do not warp as is often the case with untreated reeds. In addition, treated reeds retain enough moisture for at least one week after treatment to prevent the warping that generally accompanies dryness in untreated reeds. Such treated reeds are easily playable by simply rehydrating the reed with saliva. Regular treatment with the preferred composition allows reeds to be used between twice and three times as often as untreated reeds. Thus, if an untreated reed were acceptable for five performance or practice sessions, a reed treated according to the invention would be acceptable for use for 10–15performance or practice sessions.

These results were seen with all brands and strengths of reeds tested for all instruments tested. Treatment after each use gave equivalent results to periodic (weekly) treatment.

Reeds that have never been treated and are no longer acceptable for demanding musical performance because of extensive use, can often be "revitalized" by treatment with the composition of the invention so that they again become acceptable for demanding musical performance. The duration of the revitalization is variable, however, indicating that regular treatment with the composition of the invention is more effective than waiting for the reed to become unsuitable for playing before treatment.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A method of treating a reed having a playing surface, comprising:

(a) providing an aqueous composition comprising an oxidizing agent and a humectant;

(b) placing an aliquot of the composition in a container which is of sufficient size and dimensions to allow placement of the reed in the container;

(c) submerging the reed in the composition at least up to the end of the playing surface of said reed;

(d) soaking said reed in said composition until bubbling action ceases;

(e) removing said reed from the composition; and (f) wiping said reed to remove excess liquid.

2. A method according to claim 1, wherein providing said composition comprises providing a composition containing hydrogen peroxide as the oxidizing agent and glycerol as the humectant.

3. A method according to claim 1, wherein providing said composition comprises providing a composition containing 3% hydrogen peroxide as the oxidizing agent and 7–8% glycerol as the humectant.

* * * * *

UNITED STATES PATENT AND TRADEMARK OFFICE

CERTIFICATE OF CORRECTION

PATENT NO. : 5,379,673

DATED : January 10, 1995

INVENTOR(S) : Robert F. Vogt

It is certified that error appears in the above-indentified patent and that said Letters Patent is hereby corrected as shown below:

Column 1, line 23, replace "of ten" with --often--
Column 4, line 67, replace "10-15performance" with --10-15 performance--

Signed and Sealed this

Seventh Day of March, 1995

*Attest:*

Bruce Lehman

BRUCE LEHMAN

*Attesting Officer*

*Commissioner of Patents and Trademarks*